US008482512B2

(12) United States Patent
Adachi et al.

(10) Patent No.: US 8,482,512 B2
(45) Date of Patent: Jul. 9, 2013

(54) LIQUID CRYSTAL BACKLIGHT APPARATUS

(75) Inventors: Takeshi Adachi, Kumagaya (JP); Masahiko Nagano, Yokohama (JP); Kohji Nagano, legal representative, Yokohama (JP)

(73) Assignees: Mitsumi Electric Co., Ltd., Tokyo (JP); ATRC Corporation, Saitama (JP)

( * ) Notice: Subject to any disclaimer, the term of this patent is extended or adjusted under 35 U.S.C. 154(b) by 393 days.

(21) Appl. No.: 12/920,850

(22) PCT Filed: Mar. 4, 2009

(86) PCT No.: PCT/JP2009/054085

§ 371 (c)(1),
(2), (4) Date: Oct. 13, 2010

(87) PCT Pub. No.: WO2009/110513

PCT Pub. Date: Sep. 11, 2009

(65) Prior Publication Data

US 2011/0018912 A1 Jan. 27, 2011

(30) Foreign Application Priority Data

Mar. 7, 2008 (JP) ..... 2008-057224
Jan. 14, 2009 (JP) ..... 2009-006159

(51) Int. Cl.
*G09G 3/34* (2006.01)

(52) U.S. Cl.
USPC ..... 345/102

(58) Field of Classification Search
USPC ..... 345/102; 362/230, 231, 612, 613
See application file for complete search history.

(56) References Cited

U.S. PATENT DOCUMENTS

| | | | | |
|---|---|---|---|---|
| 7,321,354 | B1 * | 1/2008 | Jacobsen et al. | 345/102 |
| 2006/0125773 | A1 * | 6/2006 | Ichikawa et al. | 345/102 |
| 2006/0152468 | A1 * | 7/2006 | Ozaki | 345/102 |
| 2007/0223219 | A1 * | 9/2007 | Medendorp et al. | 362/231 |

FOREIGN PATENT DOCUMENTS

| | | |
|---|---|---|
| JP | 7-191311 | 7/1995 |
| JP | 2001-327730 | 11/2001 |
| JP | 2004-184937 | 7/2004 |
| JP | 2004-191490 | 7/2004 |
| JP | 2004-246117 | 9/2004 |
| JP | 2005-517278 | 6/2005 |
| JP | 2006-133708 | 5/2006 |
| JP | 2007-514454 | 6/2007 |
| JP | 2007-323857 | 12/2007 |
| JP | 2008-009416 | 1/2008 |

(Continued)

OTHER PUBLICATIONS

Japanese Office Action mailed Aug. 16, 2011.
Japanese Office Action mailed Apr. 3, 2012.
Japanese Office Action mailed Nov. 27, 2012.

*Primary Examiner* — Kevin M Nguyen
(74) *Attorney, Agent, or Firm* — IPUSA, PLLC

(57) ABSTRACT

A liquid crystal backlight apparatus being placed behind a liquid crystal display panel in a manner facing the liquid crystal display panel and illuminating the liquid crystal display panel from behind with a backlight having plural light emitting diodes as a light source, the liquid crystal backlight apparatus including a control part configured to use 0.1-0.5 watt white light emitting diodes as the plural light emitting diodes and independently control luminance of the white light emitting diodes separately.

8 Claims, 14 Drawing Sheets

FOREIGN PATENT DOCUMENTS

| | | |
|---|---|---|
| JP | 2008-010397 | 1/2008 |
| JP | 2008-010852 | 1/2008 |
| WO | WO03/067934 | 8/2003 |
| WO | WO2005/006818 | 1/2005 |

* cited by examiner

LIQUID CRYSTAL BACKLIGHT APPARATUS

TECHNICAL FIELD

The present invention relates to a liquid crystal backlight apparatus using a light emitting diode as an illumination light for a color liquid display panel, and more particularly to a method of driving a light emitting diode for achieving color reproduction and color balance at low cost.

BACKGROUND ART

Currently, the mainstream method of displaying a color image with a liquid crystal display apparatus is by using a backlight apparatus to illuminate a transparent type liquid crystal display panel having a color filter from behind. Although CCFL (Cold Cathode Fluorescent Lamp) using fluorescent tubes were used for most backlights, their use of mercury is being controlled for preventing environmental problems. Light emitting diodes (LED) are being used as light sources as alternatives of the CCFL using mercury (See, for example, Patent Document 1).

The backlight apparatus for a liquid crystal panel is largely categorized into a direct type and an edge type. The direct type is a type in which a light source is positioned directly below a back side of a liquid crystal panel. The edge type is a type in which a light guidance plate is positioned directly below a backside of a liquid crystal panel and a light source is positioned at a side part of the light guidance plate. The edge type is already mainly used for comparatively small liquid crystal panels such as displays of mobile phones and laptop computers.

Further, as for a backlight apparatus using a light emitting diode as its light source, there is a type using a white light emitting diode and a type obtaining a white light by mixing colors of light emitting diodes of three primary colors of red, green, and blue.

However, the same as the backlight apparatus using CCFL, the backlight apparatuses using the light emitting diodes are constantly lit with a high luminance during use of the liquid crystal display apparatus and there is a demand to reduce power consumption. Therefore, in Patent Document 2, reduction of power consumption is proposed by dividing backlight into plural sub-units and adjusting luminance of each sub-unit.

Typically, because light emitting diodes have largely varying luminance and chromaticity, random use of light emitting diodes will cause uneven chromaticity and adversely affect image quality. Therefore, it is necessary to sort light emitting diodes. As a method of using such variable light emitting diodes, there is, for example, Patent Document 3.

Patent Document 1: Japanese Laid-Open Patent Publication No. 7-191311

Patent Document 2: Japanese Laid-Open Patent Publication No. 2004-191490

Patent Document 3: Japanese Laid-Open Patent Publication No. 2006-133708

DISCLOSURE OF THE INVENTION

Problem to be Solved by Invention

As disclosed in Patent Document 2, in a case of dividing a backlight into plural sub-units (which can independently have their chromaticity adjusted) and adjusting the chromaticity of areas of a display screen corresponding to the sub-units, the number of light emitting diodes of the divided sub-units is fixed (e.g., m×n where "m" and "n" are natural numbers). Therefore, the size of the sub-units cannot be changed. Thus, the areas of the display screen which can have their chromaticity independently adjusted, are also fixed. However, the area or location in the display screen where chromaticity is desired to be changed is different depending on the content of image signals. Therefore, it is difficult to reproduce an optimum image if the areas of the display screen are fixed.

Further, because the dynamic range of the liquid crystal display apparatus is small, in order to obtain optimum image quality where a liquid crystal display panel is used, it is necessary to allocate many light emitting diodes to the backlight of the liquid crystal display apparatus so that light emitting diodes corresponding to bright parts of a screen are bright and light emitting diodes corresponding to dark parts of a screen are dark. By doing so, power consumption can be reduced because only light emitting diodes for necessary parts need to be brightened. However, in order to increase the number of light emitting diodes and enable the light emitting diodes to be controlled separately, it is usually necessary to provide control lines of light emitting diodes in proportion to the number of light emitting diodes. This causes complexity of the control lines and results in an increase of manufacturing costs.

Therefore, in light of the above, according to an embodiment of the present invention, it is an object to provide a liquid crystal backlight capable of achieving low power consumption and obtaining optimum image quality by arranging many light emitting diodes having relatively small electric power (approximately 0.1-0.5 watts) as a backlight and separately controlling the light emitting diodes with control lines extending from the outside.

Means for Solving Problem

In order to achieve such object, according to a first embodiment of the present invention, a liquid crystal backlight apparatus being placed behind a liquid crystal display panel in a manner facing the liquid crystal display panel and illuminating the liquid crystal display panel from behind with a backlight having a plurality of light emitting diodes as a light source, the liquid crystal backlight apparatus includes: a control part configured to use 0.1-0.5 watt white light emitting diodes as the plural light emitting diodes and independently control luminance of the white light emitting diodes separately.

Accordingly, by using many white light emitting diodes having relatively low power, low power consumption can be achieved. In addition, separately controlling the luminance of the white light emitting diodes contributes to displaying of high definition images.

According to a second embodiment of the present invention, a liquid crystal backlight apparatus being placed behind a liquid crystal display panel in a manner facing the liquid crystal display panel and illuminating the liquid crystal display panel from behind with a backlight having a plurality of light emitting diodes as a light source, the liquid crystal backlight apparatus includes: a control part configured to use color light emitting diodes as the plural light emitting diodes, the color light emitting diodes forming a group that is a minimum unit N (N being a natural number) for obtaining a white color by mixing colors; wherein the control part is configured to independently control luminance and/or chromaticity of the color light emitting diodes in group units or independently.

Accordingly, by controlling a group formed of color light emitting diodes in unit of groups or independently, low power consumption can be achieved. In addition, not only luminance but chromaticity can also be optimized, and high quality images can be attained.

According to a third embodiment of the present invention, a liquid crystal backlight apparatus being placed behind a liquid crystal display panel in a manner facing the liquid crystal display panel and illuminating the liquid crystal display panel from behind with a backlight having a plurality of light emitting diodes as a light source, the liquid crystal backlight apparatus includes: a control part configured to use white light emitting diodes and one or more color light emitting diodes as the plural light emitting diodes, a combination of the white light emitting diodes and the one or more color light emitting diodes forming a group; wherein the control part is configured to independently control luminance and/or chromaticity of the white light emitting diodes and the one or more color light emitting diodes in group units or independently.

Accordingly, by forming a group with white light emitting diodes and color light emitting diodes, luminance and/or chromaticity can be controlled with high precision.

According to a fourth embodiment of the present invention, the liquid crystal backlight apparatus of the second embodiment, a plurality of single light emitting diodes which is the smallest unit of the plural light emitting diodes or the groups are integrated into a block; wherein a plurality of the blocks are integrated to form the backlight.

Accordingly, a backlight can be divided into blocks, to thereby enable simple control.

According, to a fifth embodiment of the present invention, the liquid crystal backlight apparatus of the second embodiment has the control unit includes a control circuit installed in each unit of the plural light emitting diodes, wherein the control circuit is supplied with information required for controlling luminance of the light emitting diodes via a control line from outside, wherein the control line is connected in a column or row direction of the light emitting diodes arranged in large numbers.

Accordingly, a simple configuration can be obtained in which the number of control lines can be reduced to a number substantially equivalent to the rows or columns. Further, the luminance of the many light emitting diodes of the backlight can be independently controlled with a few control lines. Therefore, unevenness of luminance and color can be corrected for each light emitting diode. Thereby, the cost of the backlight can be reduced because there is no need to sort light emitting diodes.

According to a sixth embodiment of the present invention, in the liquid crystal backlight apparatus of the fifth embodiment, other than luminance data of each light emitting diode, the information supplied to the control circuit from outside by the control line includes at least address information, block information, and information determining an illumination period.

Accordingly, even in a case where there are few control lines, detailed information required for controlling each of the light emitting diodes can be provided to the control circuit. Thus, high precision control can be achieved.

According to a seventh embodiment of the present invention, in the liquid crystal backlight apparatus of the sixth embodiment, the control circuit includes a data holding part for identifying address information sent from the control line, reading corresponding luminance data, storing the read luminance data until the next luminance data is read.

Accordingly, luminance data of each light emitting diode can be positively stored until the next luminance data is updated. Luminance control for each clock pulse can be positively achieved and then transferred to the next luminance. The control of luminance of each light emitting diode can be executed without skipping data.

Effect of the Invention

With the above-embodiments of the present invention, the luminance of many light emitting diodes can be easily controlled with a few control lines from outside. Therefore, unevenness of each light emitting diode can be easily corrected. The luminance of the backlight can be precisely controlled according to the content of image signals. Thereby, the dynamic range of the liquid crystal display apparatus can be increased and an optimum image can be obtained at low cost and low power consumption. Thus, this can be effectively applied to large size liquid crystal televisions, monitors, and the like.

EXPLANATION OF REFERENCE NUMERALS

Figure 1:
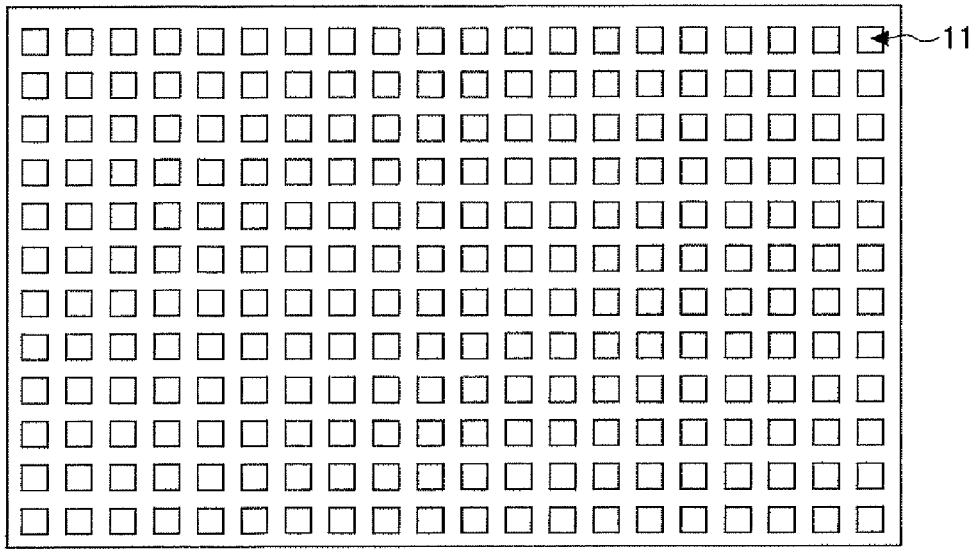
FIG. 1 is a diagram illustrating an arrangement of light emitting diodes of a direct type backlight apparatus.

11 white light emitting diode
12 red LED (light emitting diode)
13 green LED (light emitting diode)
14 blue LED (light emitting diode)
15 color light emitting diode
16 light emitting diode
20, 20*a* control circuit
30, 30*a*, 70, 101 decoder
31, 71, 110 luminance information
311, 711, 111 address information
312, 712, 112R, 112G1, 112G2, 112B luminance data
313, 713, 113 attribute
32, 72 clock, etc.
33, 331, 332, 333, 334, 335, 721, 722, 723 control line
51 luminance data obtaining part
52 data holding part
53 PWM (Pulse Width Modulation) circuit
60 entire backlight
61, 91 block in a case of 5×3 unit
90 unit in a case of color light emitting diode
150 backlight apparatus
171 luminance information generation part
172 clock signal etc. generation part
180 memory
190 image signal process circuit
200 liquid crystal display panel
210 source driver
220 gate driver
230 liquid crystal panel control circuit
250 liquid crystal display apparatus

BEST MODE FOR CARRYING OUT THE INVENTION

In the following, preferred embodiments of the present invention are described with reference to the accompanying drawings.

Figure 2:
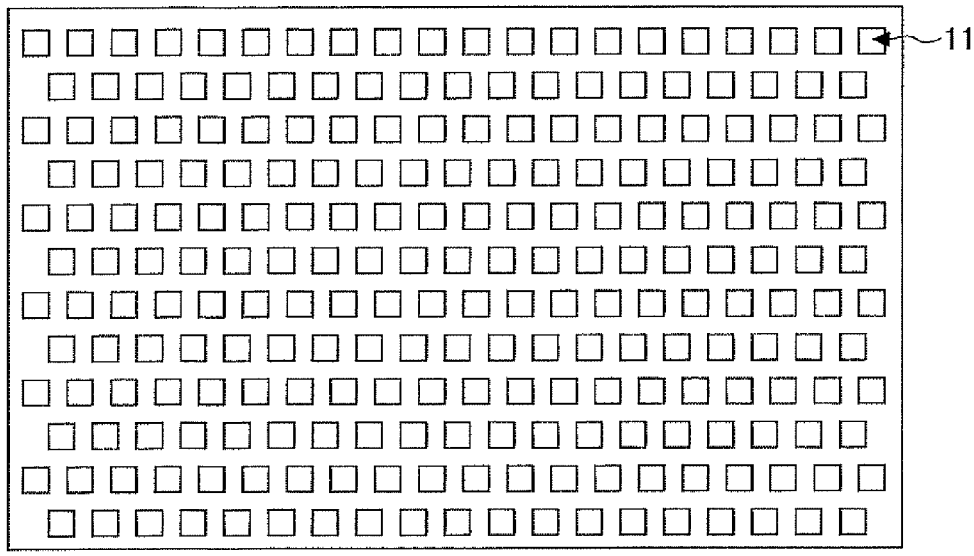
FIG. 2 is a diagram illustrating another embodiment of an arrangement of light emitting diodes of a direct type backlight apparatus.

As an example of a best mode for carrying out the present invention, a case of using white light emitting diodes as the light source of a backlight is described. FIG. 1 illustrates an embodiment in which many white light emitting diodes 11 are substantially evenly arranged on an entire plane of a backlight. Further, FIG. 2 illustrates another embodiment of an arrangement of light emitting diodes 11. It is to be noted that the present invention is not limited to the arrangements of light emitting diodes illustrated in FIGS. 1 and 2.

Figure 3:
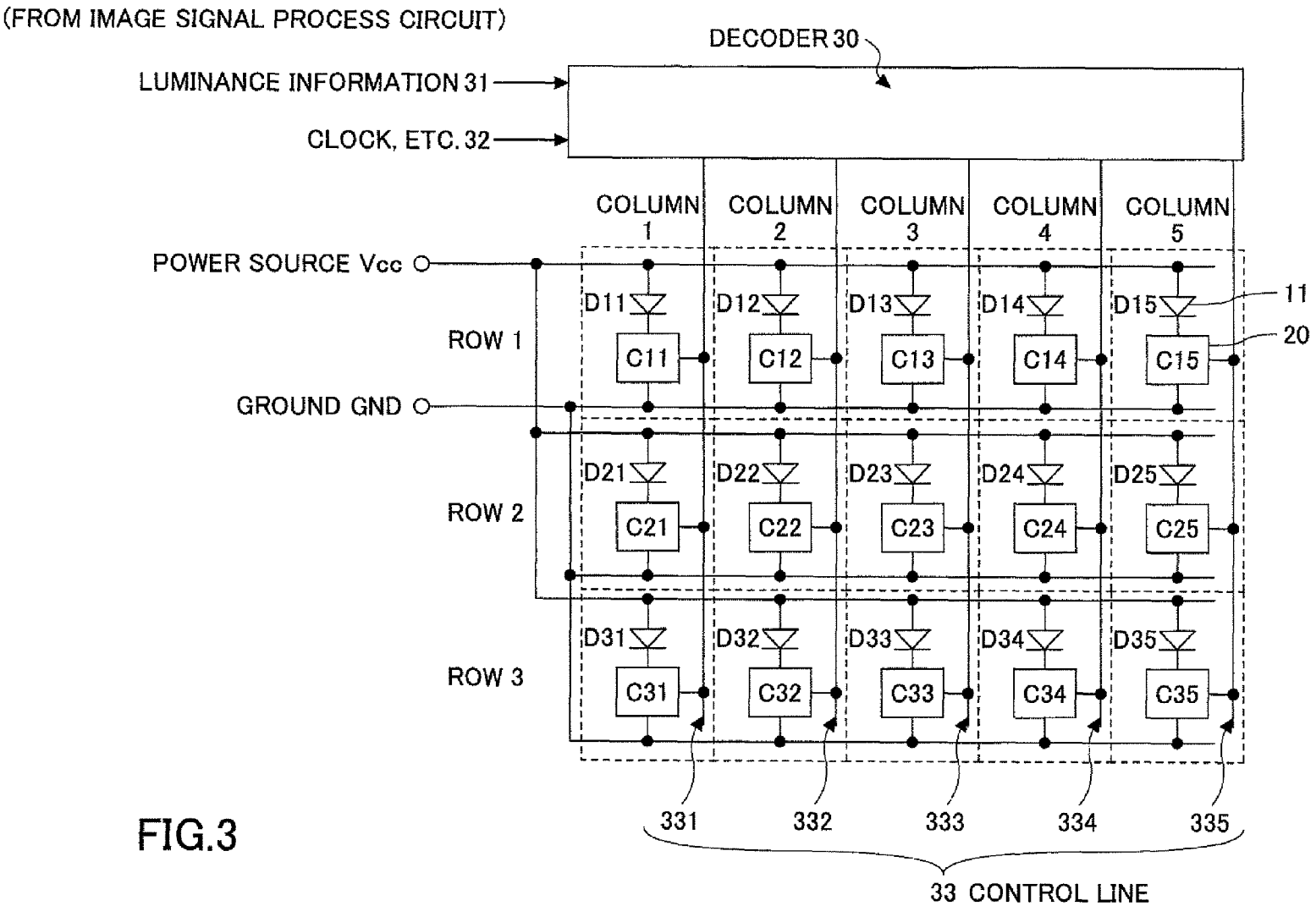
FIG. 3 is a diagram for describing operations of a backlight apparatus according to an embodiment of the present invention.

Next, controlling and connecting of the many light emitting diodes are described with reference to FIG. 3. For the sake of simplifying explanation, this embodiment is described in a case where 5×3 light emitting diodes 11 are arranged. FIG. 3 illustrates an exemplary configuration of a backlight including white light emitting diodes of a backlight apparatus according to an embodiment of the present invention. In FIG. 3, the backlight apparatus includes plural white light emitting diodes 11 that are arranged in 3 rows and 5 columns in a lattice-like manner, control circuits 20 that control the white light emitting diodes 11 separately, a decoder 30 that controls the driving of each control circuit 20, and control lines 33 that electrically connect the decoder 30 and each control circuit 20. It is to be noted that reference numerals D11-D35 are assigned to the position of each of the white light emitting diodes 11 for indicating their positions on a backlight. Reference numerals C11-C35 are assigned to the positions of the control circuits 20 in correspondence with D1-D35 assigned to each of the positions of the light emitting diodes 11. In FIG. 3, the decoder 30 is connected to control terminals of the control circuits 20 on each row (e.g., at C11-C31 in the first column) by the control lines 331. In the same manner, for columns 2 to 5, the decoder 30 is connected to control terminals of the controls circuits 20 of the same column by the control lines 332, 333, 334, and 335. The anode side of the light emitting diodes 11 on each row is connected to a power source. The cathode side of the light emitting diodes 11 on each row is connected to a drive terminal of each control circuit 20. A ground terminal of each control circuit is grounded. In connecting the terminals of the light emitting diodes 11, the anode side of the light emitting diode 11 may be connected to the control circuit 20 and the cathode side of the light emitting diodes 11 may be connected to the ground GND in accordance with circuit configuration.

Luminance information 31 is input to the decoder 30 by serial signals from an image signal process circuit (not illustrated) for controlling the luminance of each light emitting diode 11 of the backlight apparatus. The decoder 30 is for decoding the serially input luminance information 31 in units of each column of light emitting diodes 11. The luminance information 31 includes luminance data in units of each light emitting diode 11 and address information for identifying the light emitting diode corresponding to the luminance data among the many light emitting diodes 11.

Starting from the top row, the luminance data is transmitted and acquired at the same time by the control circuits C11-C15 positioned on the same row. In the same manner, the luminance data is also sequentially acquired by the control circuits positioned on rows 2 and 3. Further, the luminance data acquired by each control circuit in row units can be stored by a data storage part (not illustrated) for storing the luminance data in the control circuit until the next time of acquiring luminance data. Therefore, in a case of switching the acquiring of luminance data from the first row to the second row or the third row, the luminance data of the first row is maintained until the next period of acquiring luminance data (next acquiring period). Although the acquiring period is typically equivalent to 1 screen (1 field or 1 frame), the acquiring period can be discretionally set by transmitting data of the time for maintaining the luminance information 31.

It is to be noted the luminance data 31 is sequentially acquired from a higher row to a lower row in the above-described embodiment. The supplying of image signals to the liquid crystal panel is also performed from top to bottom and the response speed of the liquid crystal panel is slow. Therefore, it is preferable for the light emitting diodes 11 of the backlight to light up slightly after the image signal.

Further, the luminance data can be transmitted to a higher row to a lower row at a shorter time in case where the transmission time of the luminance information 31 is sufficiently faster compared to a single frame f, for example, a time of 60 Hz (approximately 16.7 ms).

Figure 4:
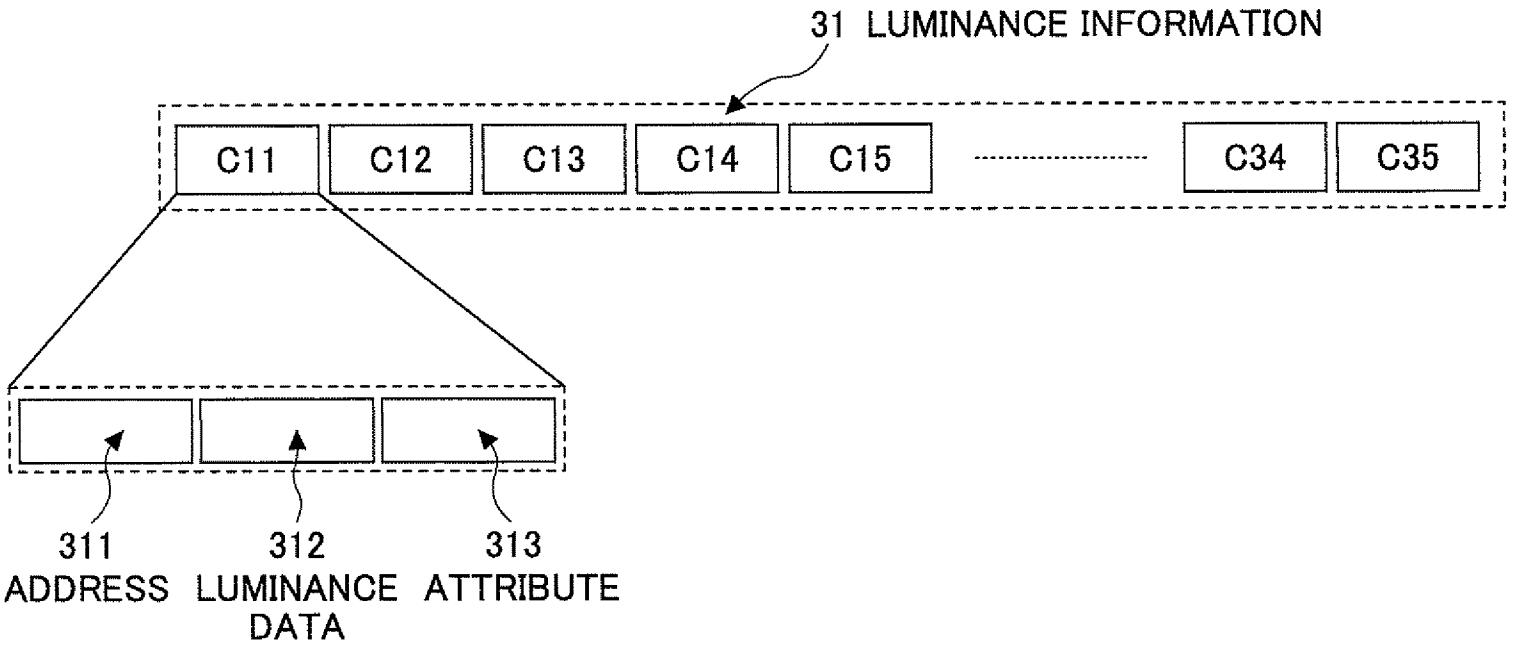
FIG. 4 is a diagram for describing a configuration of luminance information according to an embodiment of the present invention.

Next, the luminance information 31 transmitted from an image signal process circuit (not illustrated) to the decoder 30 is described in detail with reference to FIG. 4. FIG. 4 is a schematic diagram illustrating an example of the content of a serial signal including luminance information 31 transmitted from the image signal process circuit (not illustrated) to the decoder 30. The upper part of FIG. 4 illustrates an example of an overall configuration of a serial signal including luminance information 31. The lower part of FIG. 4 illustrates an example of a detailed configuration of a unit of luminance information 31 transmitted to each control circuit 20.

As illustrated in the upper part of FIG. 4, the luminance information 31 is sequentially transmitted to each light emitting diode 11, that is, sequentially transmitted from C11 (row 1, column 1) to C35 (row 3, column 5). The luminance information 31 for a unit of the light emitting diode 11 includes address information 311, luminance data 312, and attribute 313 as illustrated in the lower part of FIG. 4. The address information 311 is for identifying each of the light emitting diodes 11. The luminance data 312 includes digital signals of luminance information of the light emitting diodes 11 indicating, for example, a 256 gradation with 8 bits. The attribute 313 includes information indicating the timing for starting the illumination of the light emitting diodes 11 or the period of illuminating the light emitting diodes 11.

It is to be noted that block information (not illustrated) may be added to the address information 311. For example, in a case where a liquid crystal backlight apparatus according to, an embodiment of the present invention is used in a large size liquid crystal panel, it may be convenient to control light emitting diodes by dividing the backlight into a number of blocks. By preparing backlight blocks of a given size and arranging the blocks in correspondence with screen size, the backlight can be made common. In a case of using the block configuration, block information designates the blocks and address information that identifies the light emitting diodes in the blocks.

Further, the decoder 30 is a circuit for rearranging the luminance information in units of rows by using, for example, clocks 32, etc., of input serial signals of the luminance information 31. With this circuit configuration, luminance information 31 is supplied to the control circuits 20 of the light emitting diodes 11 placed on the first-third rows and connected to control lines 331, 332, 333, 334, and 335. Owing to the address information 311 included in the luminance information 31, only the luminance information of control circuits 20 having corresponding addresses are acquired, and control circuits 20 having, no corresponding address are unaffected. It is to be noted that the clocks etc., 32 include systems clock for reading out luminance information and block clocks for enabling identification of blocks.

Figure 5:
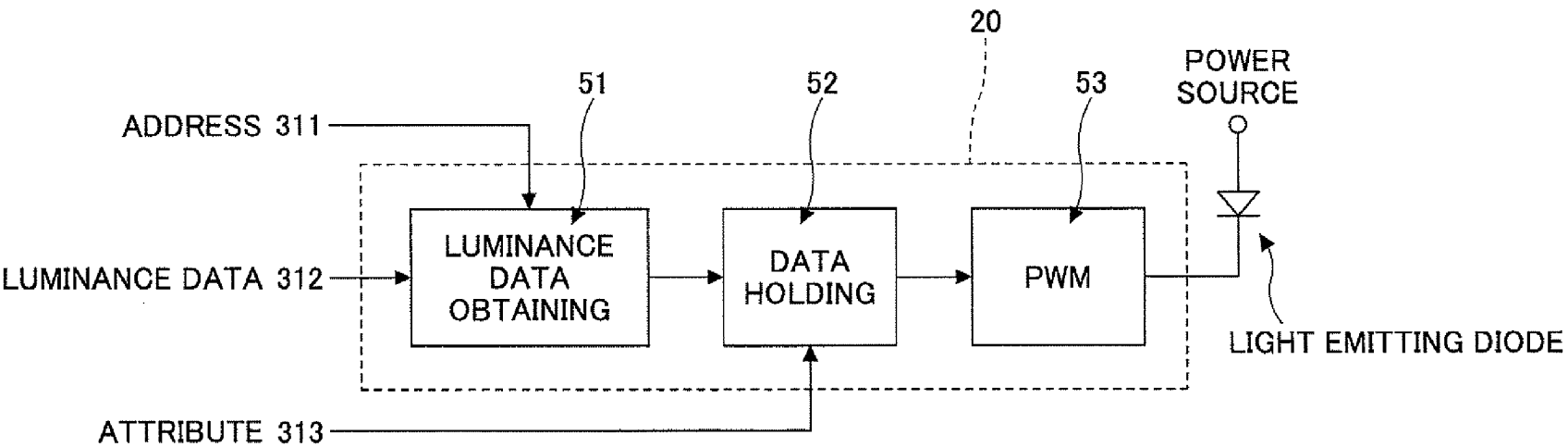
FIG. 5 is a block diagram for describing controls of light emitting diodes according to an embodiment of the present invention.

Next, the control circuit 20 that controls the luminance of the light emitting diode 11 is described with reference to FIG. 5. FIG. 5 is a block diagram of the control circuit 20 that controls the luminance of the light emitting diode 11. In FIG. 5, the address information 311, the luminance data 312, and the attribute 313 are supplied to the control circuit 20 of the light emitting diode 11 via control lines 33. In each control circuit 20, luminance data 312 and address information 311 are acquired by a luminance data obtaining part 51. The obtained luminance information 312 is recorded in a memory of a data holding part 52 and is held for a predetermined period according to information of the attribute 313. The held luminance data has its pulse width modulated by a PWM (Pulse Width Modulation circuit) 53 and is connected to a cathode side of the light emitting diode 11. Thereby, the light emitting diode 11 is lit with a luminance matching the luminance information. It is to be noted that the driving of the light emitting diodes 11 may be performed by a constant current circuit instead of the pulse width modulation circuit, so the luminance of the light emitting diodes 11 are controlled according to the size of electric current.

Figure 6:
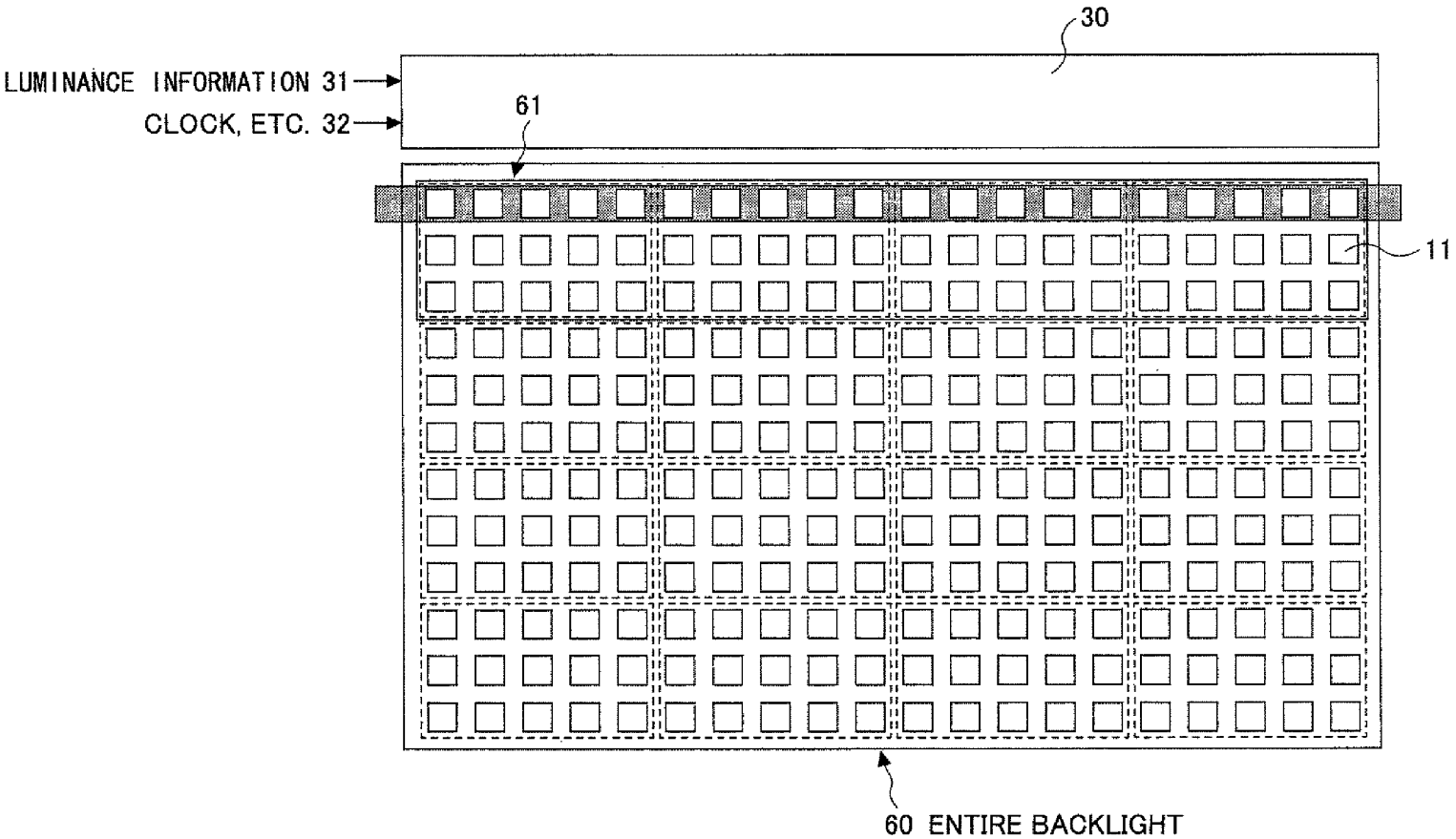
FIG. 6 is a diagram for describing a block configuration according to an embodiment of the present invention.

The embodiment above describes an example where 15 (3×5) white light emitting diodes 11 are used. However, in the next example illustrated in FIG. 6, the 15 white light emitting diodes form a single block and plural of these blocks are used. FIG. 6 illustrates an example of a backlight 60 formed by arranging 16 (4×4) blocks 61 in which each block 61 includes 15 (3×5) white light emitting diodes 11. In a case where the backlight 60 is formed of plural blocks, the backlight 60 is operated in units of each of the rows of the horizontally arranged blocks 61. That is, luminance information 31 is acquired from the 3 rows of light emitting diodes 11 of the 4 horizontally arranged blocks 61 at the top row of FIG. 6 in an order starting from the top row, the second row, and the third row of the light emitting diodes 11.

In other words, information of each of the light emitting diodes 11 of the blocks 61 is collectively obtained in correspondence with each block 61 in a case of inputting luminance information 31 to the decoder 30. By obtaining the luminance information 31 in units of blocks 61, the amount of luminance data 31 transmitted/received and the number of control lines 33 can be reduced.

Figure 7:
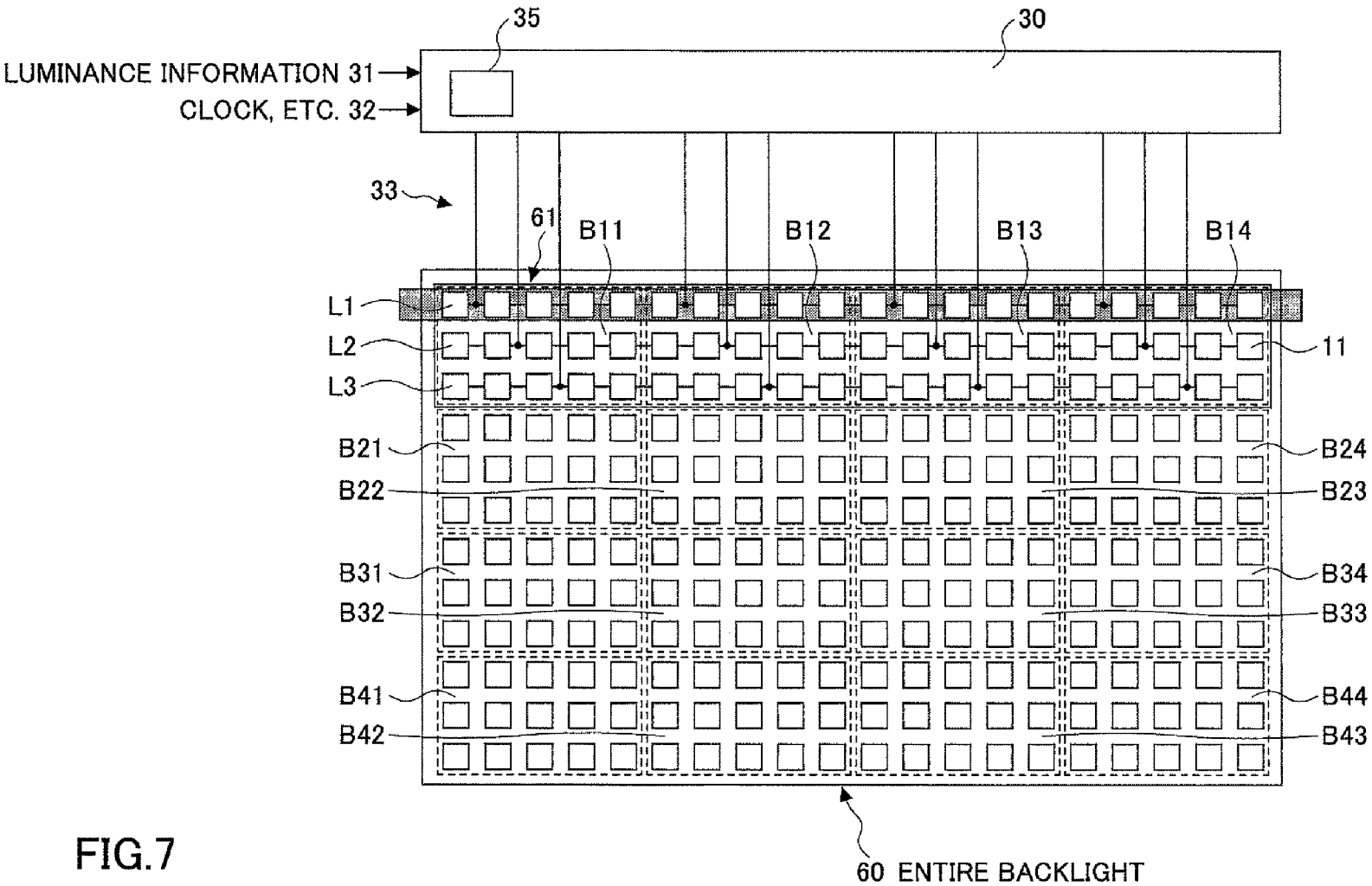
FIG. 7 is a schematic diagram illustrating a configuration of a backlight apparatus according to an embodiment of the present invention in a case where a backlight has a block configuration.

FIG. 7 is a schematic diagram illustrating a configuration of a backlight apparatus according to an embodiment of the present invention in a case where the backlight 60 is formed of blocks. In FIG. 7, the backlight apparatus according to an embodiment of the present invention includes plural light emitting diodes 11 provided on the entire backlight 60. The plural light emitting diodes 11 are grouped into 16 (4×4) blocks 61 in which each block 61 is assigned with reference numerals B11-B44 corresponding to the position of the blocks 61. Each block 61 includes 15 (3 rows×5 columns) light emitting diodes. The decoder 30 is connected, via control lines 33, to each light emitting diode 11 of each block 61 in units of rows L1-L3. It is to be noted that, although the control lines 33 between the blocks at the top row and the decoder 30 are illustrated in an abbreviated manner, the blocks B21-B44 of the second to fourth rows actually are also connected to the decoder 30. In FIG. 7, the control circuit 20 is omitted for the sake of space. Further, in FIG. 7, like components are denoted with like reference numerals as of the above-described embodiments and are not further explained. It is to be noted that the decoder 30 may include a data conversion part 35 according to necessity. Details of the data conversion part 35 are described below.

As illustrated in FIG. 7, the decoder 30 is not connected to the light emitting diodes 11 individually but is connected to the light emitting diodes 11 in units of rows of each block. Thereby, the light emitting diodes of the same row of each block can be controlled together with the same luminance. Thus, the number of control lines 33 can be reduced to ⅕. That is, in a case where the light emitting diodes 11 are individually driven and controlled, 15 control lines 33 are required for each block 61. However, with the configuration of the backlight apparatus including the blocks as illustrated in FIG. 7, the luminance of the light emitting diodes 11 can be controlled where 3 control lines 33 are used for each block 61.

Figure 8:
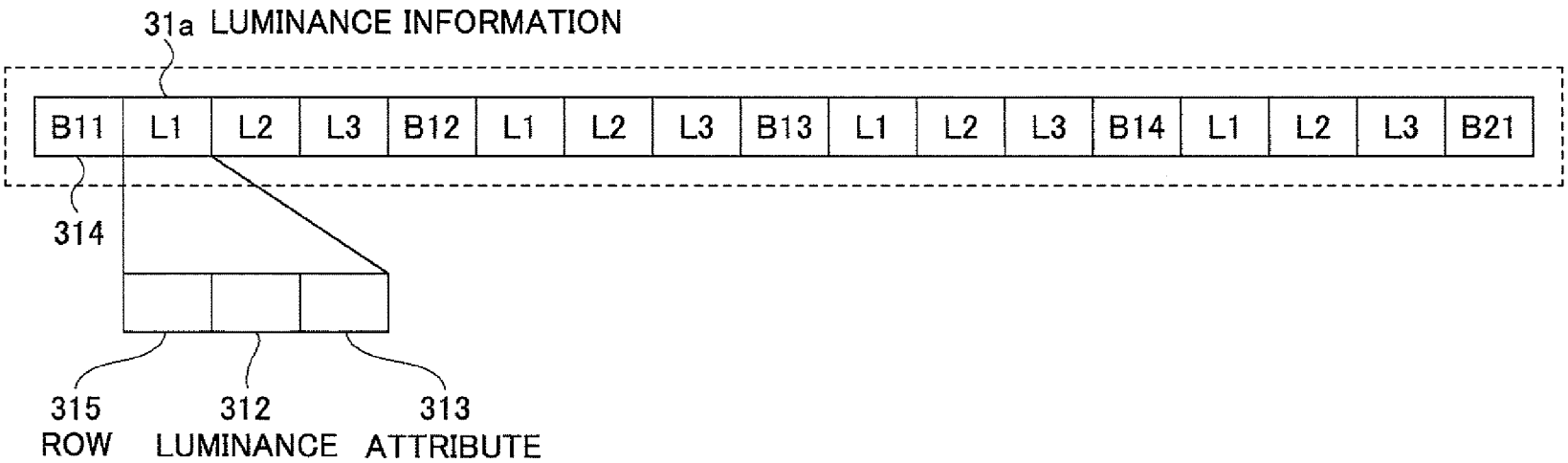
FIG. 8 is a diagram illustrating an example of a data structure of serial signals including luminance information 31*a* for driving a backlight apparatus having a block configuration.

FIG. 8 is a schematic diagram illustrating an example of a data structure of a serial signal including luminance information 31*a* for driving the backlight apparatus having the block configuration of FIG. 7. In FIG. 8, block information 314 and luminance information 31*a* of each row are included in the entire data structure having the luminance information 31*a*. The block information 314 indicates the location of a block 61 in the entire backlight 60.

On the other hand, luminance information 31*a* includes data pertaining to the luminance of each block 61. The luminance information 31*a* includes row information 315, luminance data 312, and attribute 313. The row information 315 indicates information pertaining to the rows of each block 61. For example, information indicating row 1, row 2, and row 3. In FIG. 4, address information 311 of each light emitting diode 11 is provided along with luminance data 312 and attribute information 313. However, by controlling the rows of the blocks 61 with the same luminance, the amount of data can be significantly reduced. Further, because control circuits 20 for controlling the light emitting diodes 11 need only to be provided for each row of each block, 3 control circuits 20 need only to be provided in each block. Thereby, the number of control circuits 20 can be significantly reduced along with achieving cost reduction and space saving. Further, by achieving control not only in units of rows but in units of blocks 61, the backlight apparatus can be further simplified and the amount of data transmitted/received can be further reduced because the control circuits 20 and the control lines 33 need only be provided in correspondence with the number of blocks 61.

Further, because the size of each block can be discretionally set and the number of blocks can be increased, the above-described embodiment of the present invention has a large degree of design freedom, for example, the above-described embodiment of the present invention can be applied to large screens.

It is preferable to provide a single control circuit 20 per block 61 because identification of blocks can be facilitated. The size of the block 61 can be determined according to, for example, the standard size of the light emitting diode 11 (constant current), heat generation due to power consumption and the integration size of the control circuit 20.

Figure 9:
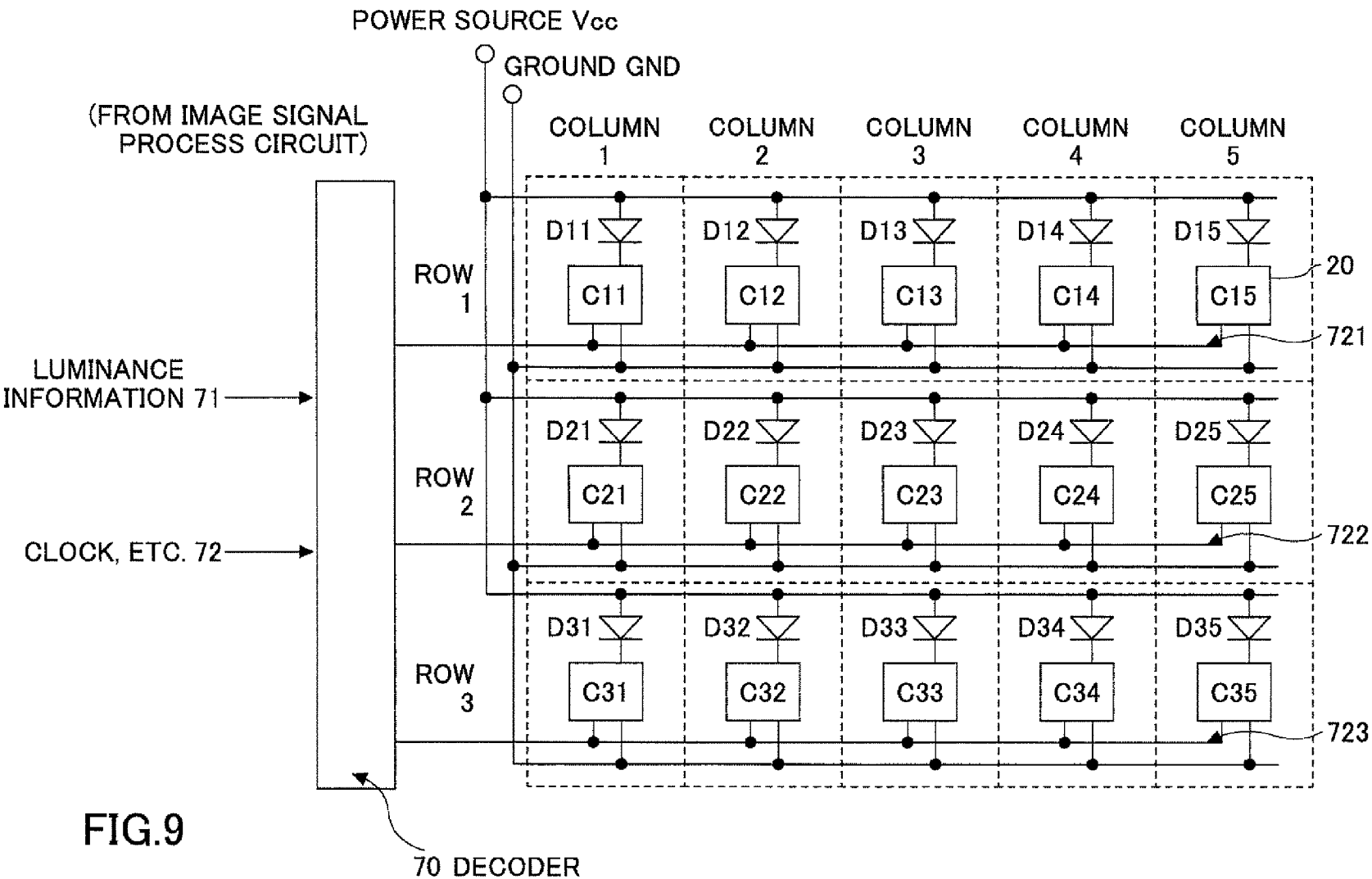
FIG. 9 is a diagram illustrating a backlight apparatus according to another embodiment of the present invention.
Figure 10:
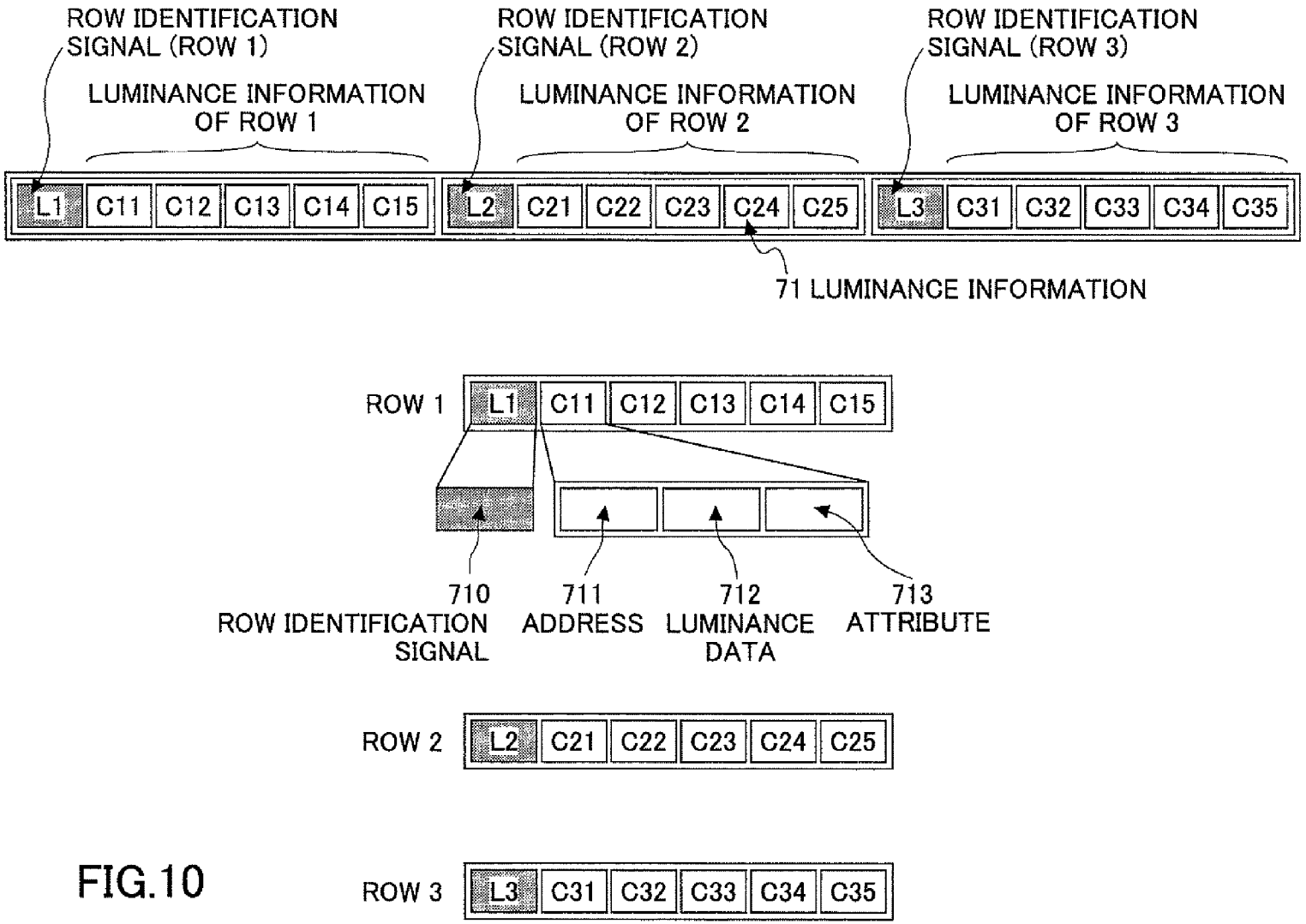
FIG. 10 is a diagram for describing luminance information according to another embodiment of the present invention.

Next, another embodiment of the present invention is described. FIG. 9 also illustrates a configuration having 15 (5×3) white light emitting diodes 11 similar to the configuration illustrated in FIG. 3. The controlling of luminance of the white light emitting diodes 11 is performed in units of rows rather than units of columns. In this, embodiment, luminance information is sequentially transferred from the top row, the second row, and the third row in this order. Then, acquiring of luminance information for each row is described with reference to FIG. 10. FIG. 10 illustrates an example of a data structure of a serial signal including luminance information. The upper part of FIG. 10 illustrates serial luminance information 71 sent from an image signal process circuit. As illustrated in FIG. 10, the luminance information 71 of this embodiment illustrated in FIG. 10 has identification signals for rows (unlike the luminance information of FIG. 4).

As illustrated in the upper part of FIG. 10, the luminance information 71 is serially transferred from an image signal process circuit in an order of the first row, the second row, and the third row. The decoder 70 of FIG. 9 separates the transferred luminance information 71 into row 1, row 2, and row 3 by using the row identification numbers 710 as illustrated in the lower part of FIG. 10 and transfers the separated luminance information 71 to the control circuits 20 (C11-C35) provided on row 1, row 2, and row 3 via control lines 721, 722, and 723 as illustrated in FIG. 9. Because the luminance information 71 transferred to each row includes the address 711 of the control circuits 20 provided on each row, the control circuit 20 corresponding to the address 711 can acquire luminance data 712 and attribute from the luminance information 71. Although the identification number of a row is required in this embodiment, it is advantageous that only a few control lines are necessary for connection with the decoder 70 in the block, for example, in a case where the number of rows is less than the number of columns (e.g., 5×3=15).

Further, in a case where a backlight apparatus having control circuits 20 is capable of individually controlling the light emitting diodes 11, the control using the block configuration described with FIGS. 6-8 can be performed. For example, it is assumed that, in the configuration illustrated in FIG. 9, the serial signals including the luminance information 31*a* for the block configuration are input to the decoder 30.

Figure 11:
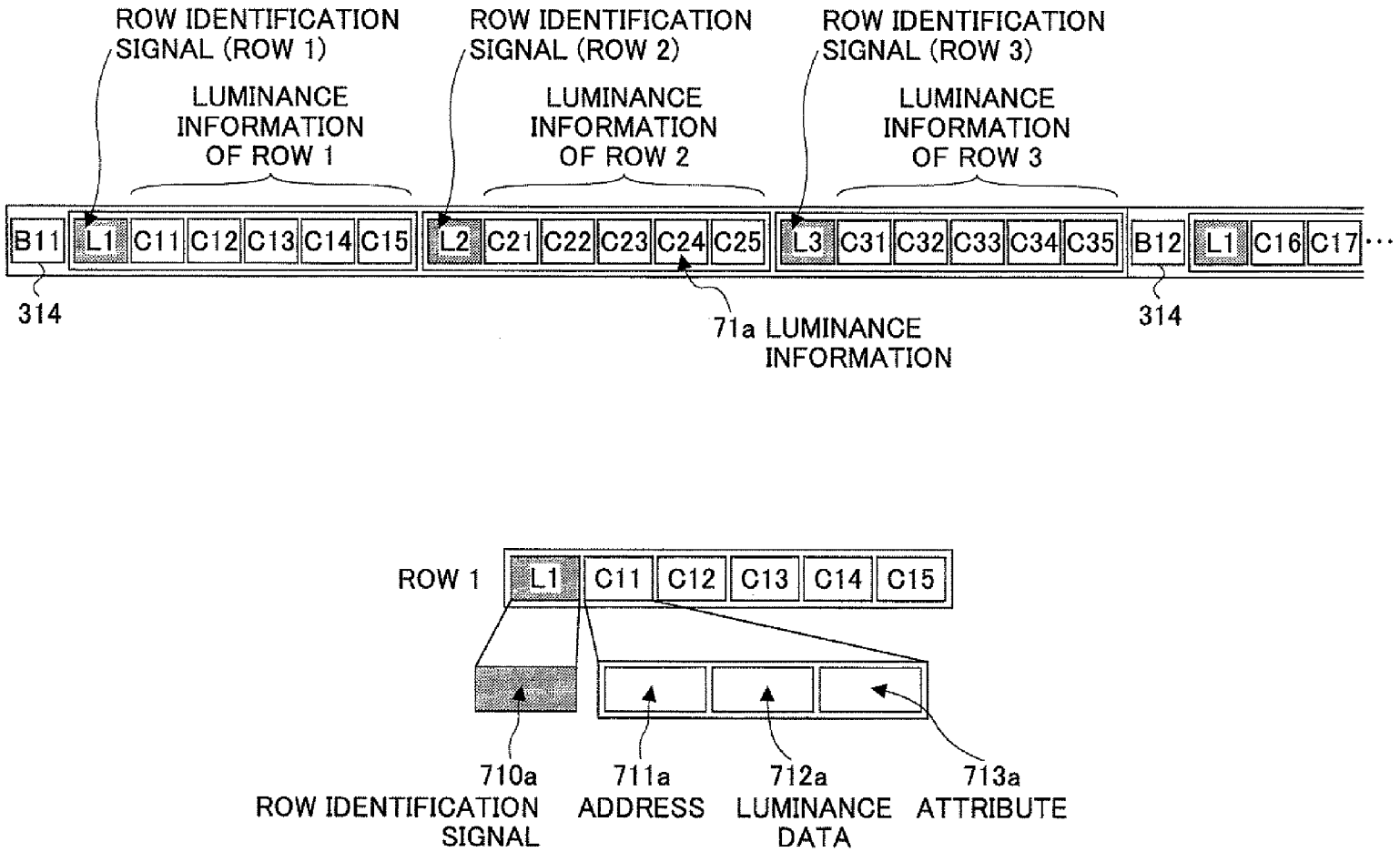
FIG. 11 is a diagram for describing an example of data conversion from serial signals corresponding to a block configuration in a case of driving a backlight apparatus for controlling individually.

FIG. 11 is a diagram for describing an example of data conversion where a backlight apparatus having control circuits for performing controls independently is driven by serial signals corresponding to the blocks illustrated in FIG. 8. The upper part of FIG. 11 illustrates an example of an entire data structure of the serial signals after data conversion. In the serial signals described with FIG. 8, other than including block information 314 used for identifying blocks, the serial signals only include luminance information 31*a* in units of rows L1, L2, L3 of each block 61. Accordingly, luminance information 71*a* for each control circuit 20 can be generated based on the luminance information 31*a* of each of rows L1, L2, and L3. As illustrated in FIG. 11, following the row identification signal L1, the data required for row 1 are luminance information C11-C15 of row 1. Accordingly, the luminance information L1 of row 1 of FIG. 8 is copied to the luminance information C11-C15 of row 1 of FIG. 11.

The lower part of FIG. 11 illustrates an internal configuration of the luminance information 71*a* of row 1. In addition to a row identification signal 710*a*, the luminance information 71*a* requires address information 711*a*, luminance data 712*a*, and attribute 13*a*. A conversion process is performed on the address information 711*a* by sequentially assigning addresses corresponding to each of the light emitting diodes 11 as address information 711*a* based on the block identification information 314. Further, a conversion process is performed on the luminance data 712*a* by copying the luminance data 312 of FIG. 8 to the luminance data 712*a* of the same row of the same block 61. Further, a conversion process may also be performed on the attribute data according to necessity.

By performing such conversion processes, serial signals including luminance information 71*a* illustrated in the upper part of FIG. 11 can be generated. Thereby, individual control circuits 20 provided in correspondence with each of the light emitting diodes 11 of FIG. 9 can be driven. Then, the control of the backlight 60 having the block configuration can be performed in a manner described with FIGS. 6-8.

It is to be noted that the conversion processes may be performed by the data conversion part 35 illustrated in FIG. 7. In one case, the data conversion part 35 may be configured to have a function of switching between individual control and block control of light emitting diodes 11 according to necessity.

Figure 12A:
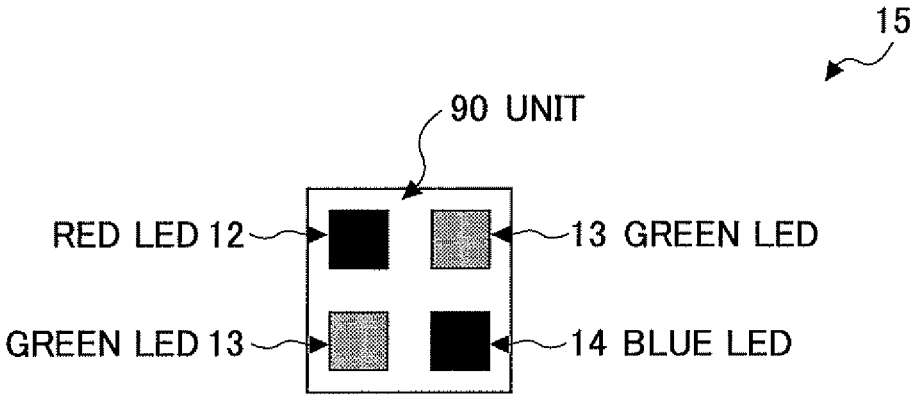
FIG. 12A is a diagram for describing an example using color light emitting diodes as a group according to an embodiment of the present invention.
Figure 12B:
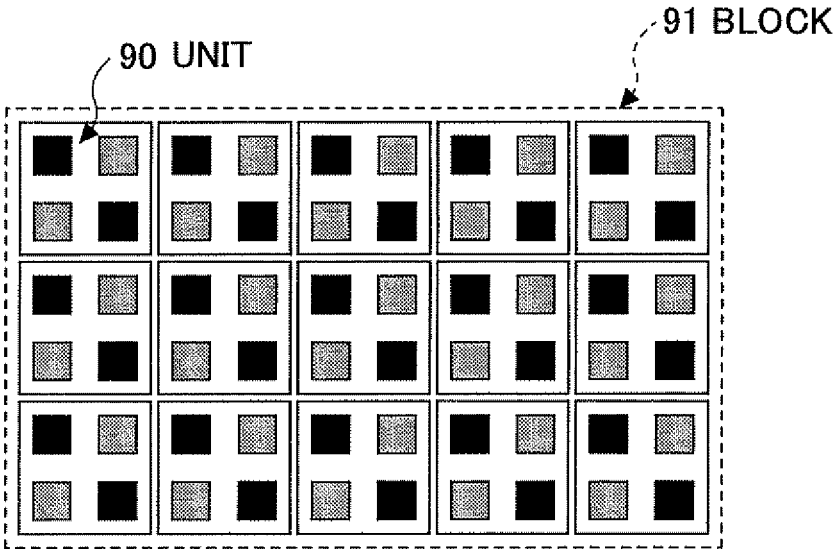
FIG. 12B is a diagram illustrating a backlight apparatus according to an embodiment of the present invention in a case where a group 90 of color light emitting diodes 15 forms a block.

Although a case of using white light emitting diodes 11 is described above, color light emitting diodes 15 may also be used. FIG. 12A is a schematic diagram illustrating an example of the color light emitting diode 15 including a unit 90 of one red light emitting diode 12, two green light emitting diodes 13, and one blue light emitting diode 14. FIG. 12B is a schematic diagram illustrating a backlight apparatus according to an embodiment of the present invention in a case where the backlight apparatus has a block configuration 91 including a total of fifteen groups 90 (5 groups in a horizontal direction, 3 groups in a vertical direction). In the following, a light emitting diode is indicated as "light emitting diode 16" in a case where the light emitting diodes 11-15 are not differentiated from each other.

As for methods of adjusting luminance of the light emitting diode 16 in a case where a color light emitting diode 15 is used as in this embodiment, there is a method of separately controlling the red light emitting diode 12, the green light emitting diode 13, and the blue light emitting diode 14 of the unit 90 and a method of controlling the light emitting diodes 12-14 as a unit 90 (see FIG. 12A). The method of separately controlling the light emitting diodes 12-14 is basically the same as the above-described embodiment using the white light emitting diode. That is, the red light emitting diode 12, the green light emitting diode 13, and the blue light emitting diode 14 simply needs to assumed as a single white light emitting diode 11, respectively. Thus, further explanation of such method is omitted. Further, separately controlling the red light emitting diode 12, the green light emitting diode 13, and the blue light emitting diode 14 requires four control lines 33 and leads to complication.

Figure 13:
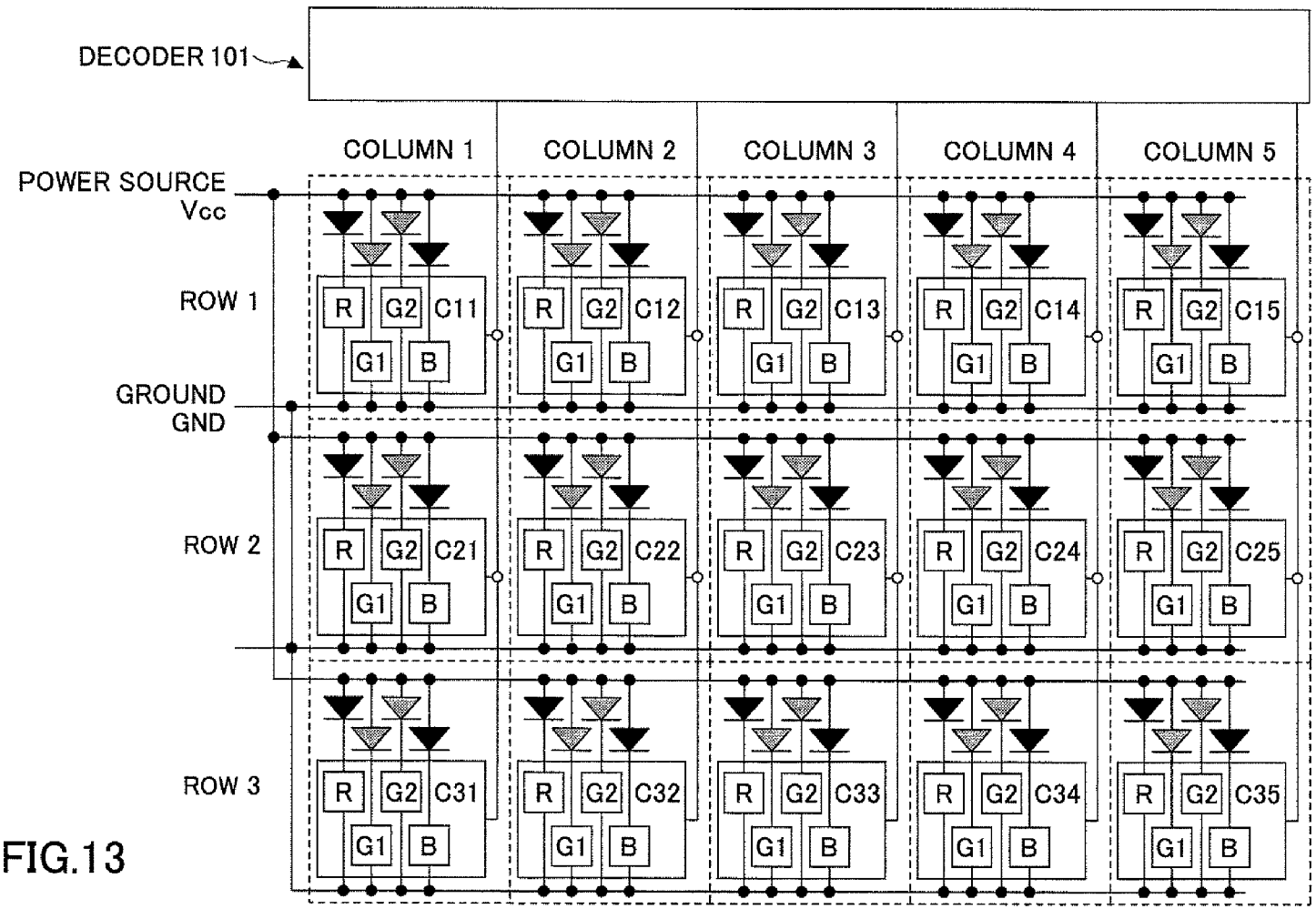
FIG. 13 is a diagram for describing operations of a backlight apparatus in a case where color light emitting diodes are used according to an embodiment of the present invention.

Next, an example of controlling luminance of the light emitting diodes 12-14 as a unit 90 (see FIG. 12A) is described with reference to FIG. 13. Compared to the case of FIG. 3 where each unit 90 uses a single white light emitting diode 11, the case of FIG. 13 is different in that each unit 90 uses four color light emitting diodes (one red light emitting diode 12, one blue light emitting diode 14, and two green light emitting diodes 13). However, the basic operations are the same as those of the white light emitting diode 11.

Nevertheless, because the case of using the color light emitting diodes 15 (12-14) uses one red light emitting diode 12, one blue light emitting diode 14, and two green light emitting diodes 13, the luminance information 110 for each unit 90 is different from the luminance information 31 where the white light emitting diode 11 is used. As a rule, in the case where the color light emitting diodes 15 (12-14) are used, four kinds of luminance information (one red light emitting diode 12, one blue light emitting diode 14, and two green light emitting diodes 14) 110 are required. However, in a case where there is little difference between the two green light emitting diodes 13, common luminance data may be shared for the two green light emitting diodes 13.

Further, by using the color light emitting diodes 15 (12-14), not only luminance but chromaticity including hue and chroma can be controlled. Further, color temperature and the like can also be controlled by the color light emitting diodes 15 (12-14). The control of chromaticity of such high definition can be achieved by using the color light emitting diodes 15 (12-14). Accordingly, high definition illumination can be achieved and a high quality image can be displayed on the liquid display panel.

Figure 14:
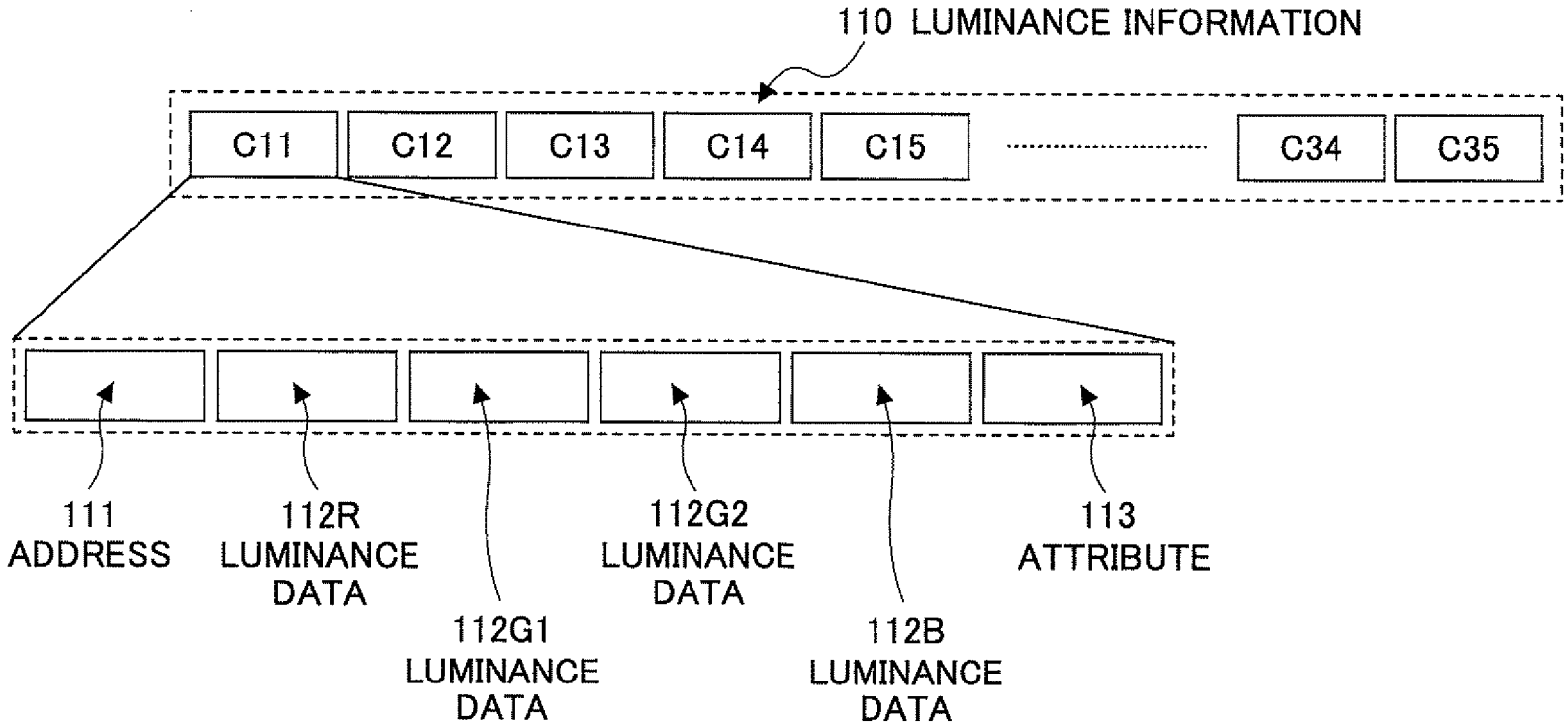
FIG. 14 is a diagram for describing a configuration of luminance information in a case where color light emitting diodes are used according to an embodiment of the present invention.

Next, luminance information 110 in a case of using the color light emitting diodes 15 (12-14) is described with reference to FIG. 14. Compared to the case of using the white light emitting diode 11 of FIG. 3, luminance data 112R, 112G1, 112G2, and 112B are different. In other words, because this case uses the color light emitting diodes 15 including one red light emitting diode 12, one blue light emitting diode 14, and two green light emitting diodes 14, it is, as a rule, necessary to use 4 kinds of luminance data (112R, 112G1, 112G2, 112B) as luminance information in correspondence with the number of the color light emitting diodes 15 (12-14). Although this embodiment describes control being performed in units of columns, the control of this embodiment may also be performed in units of rows as in the above-described embodiment of the white light emitting diodes illustrated in FIG. 9.

Next, an estimated power consumption for only a driving part of the light emitting diode 16 is calculated for determining the outcome of power consumption by the control circuits 20 (C11-C35) in a case where the color light emitting diodes 15 (12-14) are used. For the sake of simplifying explanation, each of the red light emitting diode 12, the blue light emitting diode 14, the green light emitting diode 14 has a rated current of 30 mA and the light emitting diode 16 is driven by PWM (Pulse Width Modulation). Further, in a case where the voltage drop of a switching semiconductor device is 0.5 V when the PWM is switched on, power consumption of a single light emitting diode 16 is 15 mW (30×0.5) and power consumption of a single unit 90 is 4 times the power consumption of the single light emitting diode 16 (i.e. 60 mW) because power consumption is the product of current and voltage.

As described above, the total power consumption is 900 mW in a case where the number of groups is 15 (5×3). Because power consumption is small at parts other than the driving part, a single IC (semiconductor circuit device) is enough to serve as the control circuits C11-C35 in a case where the power consumption is approximately 1 watt. In a case where 15 groups (5×3) form a single block, a single block 90 would include 60 light emitting diodes 16. In this case, the connection lines from an external part to the single block 90 are extremely few in which there are 5 control lines 33, 1 for the power source, and one for the ground. Therefore, cost reduction can be achieved. By mounting each of the light emitting diodes 16 and the control circuit 20 on the same printed circuit board (e.g., mounting the control circuit 20 on a side of a printed circuit board opposite of the side on which the light emitting diodes are mounted), each of the light emitting diodes 16 and the control circuits 20 can be connected by the wires on the printed circuit board.

As described above, in a case of, for example, using plural blocks 61 (e.g., 2×2=4, 4×4=16) in which a single block 61 is formed of 15 (5×3) groups, a backlight apparatus having a sufficient screen display size can be obtained. Although an example of a block configuration of 15 (5×3) groups is described above, other block configurations may be used Further, in using the color light emitting diodes 15, combinations of colors other than those described above may be used. For example, a combination of a white light emitting diode 11, a red light emitting diode 12, and a blue light emitting diode 14 may be used. With the above-described configurations, plural light emitting diodes can be independently controlled with use of few control lines 33, a power source line, and a ground line.

Figure 15:
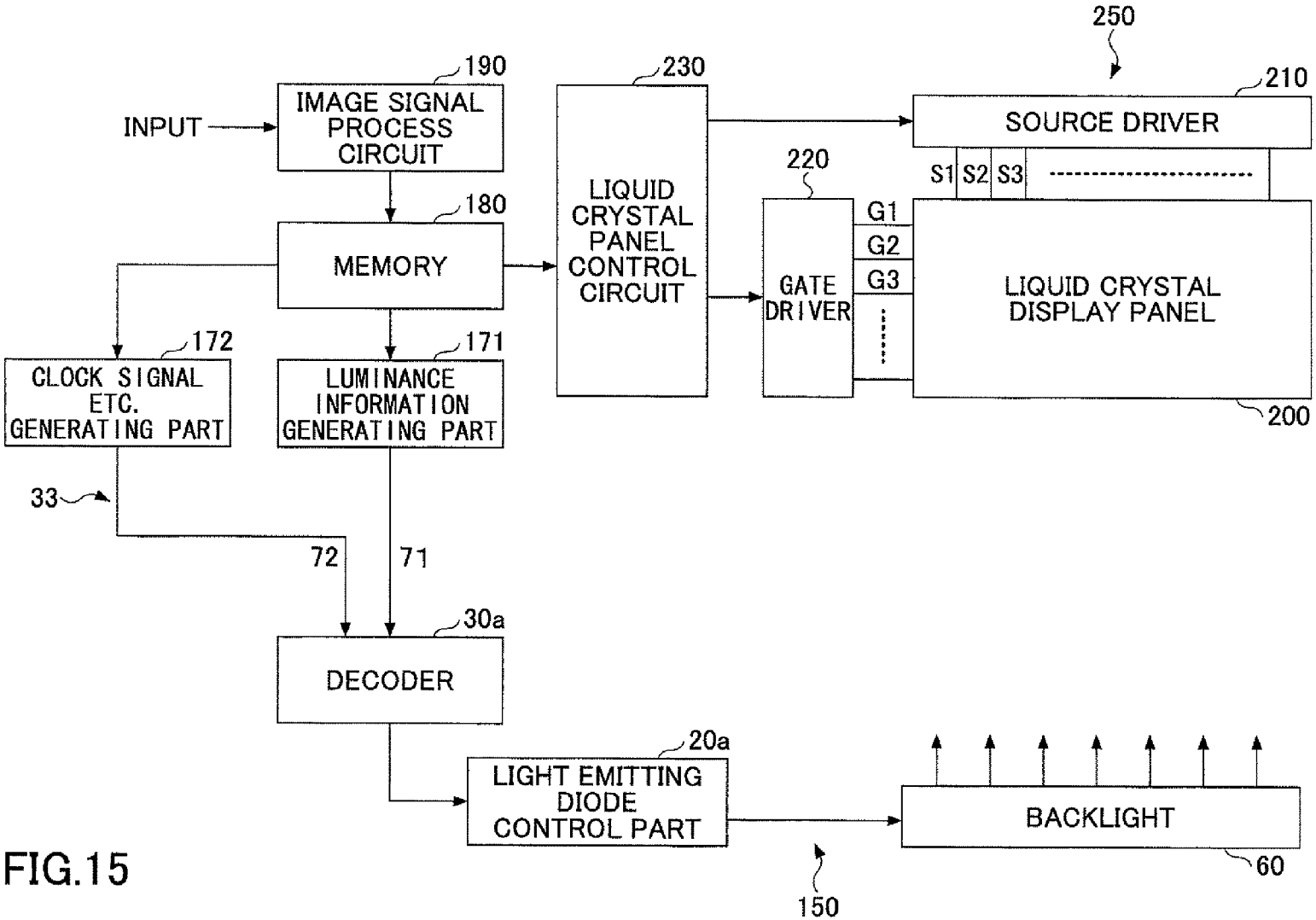
FIG. 15 is a diagram illustrating an example of an entire configuration of a backlight apparatus 150 according to an embodiment of the present invention.

FIG. 15 is a schematic diagram illustrating an exemplary configuration in which the above-described embodiment of the backlight apparatus 150 is used for the liquid crystal display apparatus 250. In FIG. 15, the backlight apparatus 150 includes the backlight 60, a light emitting diode control part 20*a*, and a decoder 30*a*. Further, the liquid crystal display apparatus 250 includes an image signal process circuit 190, a memory 180, a liquid crystal display panel 200, a source driver 210, a gate driver 220, and a liquid crystal panel control circuit 230. Further, a luminance information generation part 171 and a clock etc. generation part 172 may be provided as an interface between the liquid crystal display apparatus 250 and the backlight apparatus 150 according to an embodiment of the present invention.

The image signal process circuit 150 is a circuit for performing processes required for displaying images on the liquid crystal display panel 200 according to input image signals. For example, various image processing processes and corrections are performed.

The memory 180 is a storage part for temporarily storing image signals processed by the image signal process circuit 150.

The liquid crystal panel control circuit 230 is a circuit for performing controls required for displaying image signals stored in the memory 180 onto the liquid crystal display panel 200. More specifically, the source driver 210 and the gate driver 110 are driven at a matched timing to thereby control the displaying of the image on the liquid crystal display panel 200.

The source driver 210 is a driving IC for supplying data signals to a source of a thin film transistor provided in the liquid crystal display panel 200. The gate driver 220 is a driving IC for supplying address signals to a gate of the aforementioned thin film transistor.

The liquid crystal display panel 200 is a display panel for displaying an image on a display surface and is driven by the source driver 210 and the gate driver 220. Because the liquid crystal display panel 200 is not self-luminous, the liquid crystal display panel 200 displays images by being arranged in front of the backlight apparatus 150 and irradiating a backlight beam from the back of the backlight apparatus 150.

The luminance information generation part 171 is an external circuit for generating luminance information 31, 31*a*, 71, 71*a* as serial signals for the backlight apparatus 150 based on image signals processed by the image signal process circuit 190 and stored in the memory 180. As described above, the driving of the backlight apparatus 150 is controlled based on serial signals including luminance information 31, 31*a* provided from the luminance information generation part 171. For example, the luminance data generation part 171 may generate luminance information 31, 31*a*, 71, and 71*a* for conserving electric power by allowing image signals to light the light emitting diodes 16 corresponding to dark areas at a low luminance or for displaying images with high definition by allowing image signals to light the light emitting diodes 16 corresponding to bright areas at a high luminance according to luminance distribution of the image signals. Based on the luminance information, the backlight apparatus according to an embodiment of the present invention can control the driving of light emitting diodes 16 in a manner achieving high definition while reducing power consumption.

The clock signal generation part 172 is a part that generates clock signals and the like required for synchronizing driving operations. The generated clock signals, for example, are supplied to the decoder 30*a*.

It is to be noted that the memory 180, the luminance information control part 171, and the clock signal generation part 172 may be installed in the image signal process circuit 190, to thereby form a united body with the image signal process circuit 190.

As described above, luminance information 71 and clock signals 72 from external circuits such as the luminance information generation part 171 and the clock signal generation part 172 are input as serial signals to the decoder 30*a* via the control lines 33. The decoder 30*a* acts as a software unit that reconstructs the serial signals into luminance data and supplies the luminance data to the light emitting diode control part 20.

The light emitting diode control part 20*a* is a control part that drives the light emitting diodes 16 independently (separately) or in groups and controls the luminance of the light emitting diodes 16. As described above, the control circuit 20 performs the functions of the light emitting diode control part 20*a*. Further, the light emitting diode control part 20*a* may control the luminance of the light emitting diodes 15 in block 61 units. Although the embodiment of FIGS. 6 to 8 describes a case where the light emitting diode 16 is the white light emitting diode 11, the embodiment (control in block units) may be performed in a case where the light emitting diode 16 is the color light emitting diode 15 or a combination of the white light emitting diode 11 and the color light emitting diode 15.

The backlight 60 is a light source body that supports the light emitting diode 16*a* and irradiates a backlight to the liquid crystal panel 200 from behind the liquid crystal panel 200. The substrate including the light emitting diode 16 or a casing may be used as the backlight 60.

Accordingly, with the backlight apparatus 150 according to the above-described embodiment of the present invention, a high quality image display can be achieved by irradiating light with precisely controlled luminance from behind the liquid crystal display panel 200 based on the luminance of image signals while performing the control with low power consumption.

Further, the present invention is not limited to these embodiments, but various variations and modifications may be made without departing from the scope of the present invention.

INDUSTRIAL APPLICABILITY

The present invention can be applied to a backlight apparatus that illuminates various displays, as liquid crystal displays.

The present application is based on Japanese Priority Application Nos. 2008-57224 and 2009-6159 filed on Mar. 7, 2008 and Jan. 14, 2009, respectively, with the Japanese Patent Office, the entire contents of which are hereby incorporated by reference.

The invention claimed is:

1. A liquid crystal backlight apparatus, comprising:

a backlight configured to illuminate a liquid crystal display panel, the backlight having a plurality of light emitting diodes arranged in a matrix of rows and columns as a light source;

a control part configured to use white light emitting diodes as the plural light emitting diodes and control luminance of the white light emitting diodes separately; and a plurality of control circuits configured to receive information for controlling a luminance of the light emitting diodes, with each control circuit configured to control a corresponding light emitting diode, wherein the information is generated by image signals supplied from an image signal process circuit to the liquid crystal backlight apparatus, wherein the image signals are serially supplied to the light emitting diodes arranged in the matrix of rows and columns from a top row to a bottom row starting with a light emitting diode at a position of a first row and a first column, and wherein the light emitting diodes are lit after the image signals are supplied.

2. A liquid crystal backlight apparatus, comprising:

a backlight configured to illuminate a liquid crystal display panel, the backlight having a plurality of light emitting diodes arranged in a matrix of rows and columns as a light source;

a control part configured to use color light emitting diodes as the plural light emitting diodes, the color light emitting diodes forming a group including a minimum number N (N being a natural number) of light emitting diodes corresponding to colors for obtaining a white light by mixing the colors of the light emitting diodes; and a plurality of control circuits configured to receive information for controlling a luminance and/or a chromaticity of the light emitting diodes, with each control circuit configured to control a corresponding light emitting diode or a group unit of light emitting diodes, wherein the information is generated by image signals supplied from an image signal process circuit to the liquid crystal backlight apparatus, wherein the image signals are serially supplied to the light emitting diodes arranged in the matrix of rows and columns from a top row to a bottom row starting with a light emitting diode at a position of a first row and a first column, and wherein the light emitting diodes are lit after the image signals are supplied.

3. A liquid crystal backlight apparatus comprising:

a backlight configured to illuminate a liquid crystal display panel, the backlight having a plurality of light emitting diodes as a light source;

a control part configured to use white light emitting diodes and one or more color light emitting diodes as the plural light emitting diodes, the white light emitting diodes and the one or more color light emitting diodes forming a group; and a plurality of control circuits configured to receive information for controlling a luminance and/or a chromaticity of the light emitting diodes, with each control circuit configured to control a corresponding light emitting diode or a group unit of light emitting diodes, wherein the information is generated by image signals supplied from an image signal circuit to the liquid crystal backlight apparatus, wherein the image signals are serially supplied to the light emitting diodes arranged in the matrix of rows and columns from a top row to a bottom row starting with a light emitting diode at a position of a first row and a first column, and wherein the light emitting diodes are lit after the image signals are supplied.

4. The liquid crystal backlight apparatus as claimed in claim 2, wherein two or more of the plural light emitting diodes or two or more of the groups are integrated into a block; and wherein a plurality of the blocks are integrated to form the backlight.

5. The liquid crystal backlight apparatus as claimed in claim 2, wherein the control circuit is supplied with information required for controlling luminance of the plural light emitting diodes via a control line from outside.

6. The liquid crystal backlight apparatus as claimed in claim 5, wherein other than luminance data of each light emitting diode, the information supplied to the control circuit from outside by the control line includes at least address information, block information, and information determining an illumination period.

7. The liquid crystal backlight apparatus as claimed in claim 6, wherein the control circuit includes a data holding part for identifying address information sent from the control line, reading corresponding luminance data, and storing the read luminance data until a next luminance data is read.

8. The liquid crystal backlight apparatus as claimed in claim 1, wherein the white light emitting diodes are 0.1-0.5 watt white light emitting diodes.

* * * * *